US007784788B2

(12) United States Patent
Fukatsu et al.

(10) Patent No.: US 7,784,788 B2
(45) Date of Patent: Aug. 31, 2010

(54) SHEET STACKING APPARATUS, SHEET PROCESSING APPARATUS, AND IMAGE FORMING APPARATUS

(75) Inventors: Yasuo Fukatsu, Abiko (JP); Hitoshi Kato, Toride (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/399,009

(22) Filed: Mar. 5, 2009

(65) Prior Publication Data

US 2009/0224468 A1 Sep. 10, 2009

(30) Foreign Application Priority Data

Mar. 7, 2008 (JP) ..... 2008-057308
Feb. 17, 2009 (JP) ..... 2009-034035

(51) Int. Cl.
*B65H 39/10* (2006.01)

(52) U.S. Cl. ..... 271/292; 271/293; 271/294

(58) Field of Classification Search ..... 271/292, 271/293, 294; 414/789.9, 790, 790.4, 790.9
See application file for complete search history.

(56) References Cited

U.S. PATENT DOCUMENTS

| | | | | |
|---|---|---|---|---|
| 6,412,994 | B1 * | 7/2002 | Collard | 400/624 |
| 6,986,511 | B2 * | 1/2006 | Yamada et al. | 271/294 |
| 7,374,168 | B2 * | 5/2008 | Peeters et al. | 271/292 |
| 7,571,909 | B2 * | 8/2009 | Saeki et al. | 271/292 |
| 2007/0045948 | A1 | 3/2007 | Hanada | |

* cited by examiner

*Primary Examiner*—David H Bollinger
(74) *Attorney, Agent, or Firm*—Canon USA Inc IP Div

(57) ABSTRACT

A first tray has notches allowing second-tray arms to pass therethrough, and arm-receiving recesses in which respective first-tray arms are received. With such a plurality of sheet stacking trays that are movable vertically, a large stack of sheets can be removed efficiently, whereby a highly productive system is provided.

14 Claims, 17 Drawing Sheets

SHEET STACKING APPARATUS, SHEET PROCESSING APPARATUS, AND IMAGE FORMING APPARATUS

BACKGROUND OF THE INVENTION

1. Field of the Invention

The present invention relates to sheet stacking apparatuses that stack sheets, and sheet processing apparatuses and image forming apparatuses including the sheet stacking apparatuses.

2. Description of the Related Art

With the advancement in technology, image forming apparatuses form images on sheets at an increasing speed. Accordingly, sheet stacking apparatuses that stack sheets discharged from such image forming apparatuses are required to have a larger capacity and a higher productivity.

An example of such a sheet stacking apparatus is disclosed in US Unexamined Patent Application Publication No. 2007/0045948. In this apparatus, sheets discharged from a discharge port can be received alternately by a plurality of stacking trays that are movable vertically, whereby sheets can be stacked efficiently on the trays, realizing a large capacity of the apparatus as a whole.

However, the foregoing sheet stacking apparatus stacks not more than the maximum number of sheets stackable in the apparatus as a whole onto the vertically movable stacking trays. When the numbers of sheets stacked on all of the trays reach the maximum, the sheets need to be removed by a user. Therefore, during the removal of the sheets from all of the stacking trays, the entire operation of an image forming apparatus including the sheet stacking apparatus needs to be stopped, causing frequent occurrences of downtime and therefore reducing productivity.

SUMMARY OF THE INVENTION

In light of the above, the present invention provides a sheet stacking apparatus including a plurality of stacking trays which reduces downtime caused by stopping the sheet stacking operation, whereby a high productivity is realized.

According to an aspect of the present invention, a sheet stacking apparatus includes first and second stacking trays onto which sheets conveyed thereto are stacked; a first supporting member configured to support the first stacking tray movably; and a second supporting member configured to support the second stacking tray movably along a same moving area in which the first tray is movable. The first and second supporting members removably support the first and second stacking trays, respectively. When the first stacking tray having sheets stacked thereon is moved, the first stacking tray and the second supporting member lacking the second stacking tray thereon are capable of switching positions.

In this aspect of the present invention, a sheet stacking apparatus reduces downtime caused by stopping the apparatus and sheets can continue to be discharged without increasing the size of the apparatus. Consequently, a high productivity can be realized.

Further features of the present invention will become apparent from the following description of exemplary embodiments with reference to the attached drawings.

DESCRIPTION OF THE EMBODIMENTS

Embodiments of the present invention will now be described in detail with reference to the drawings.

Figure 1:
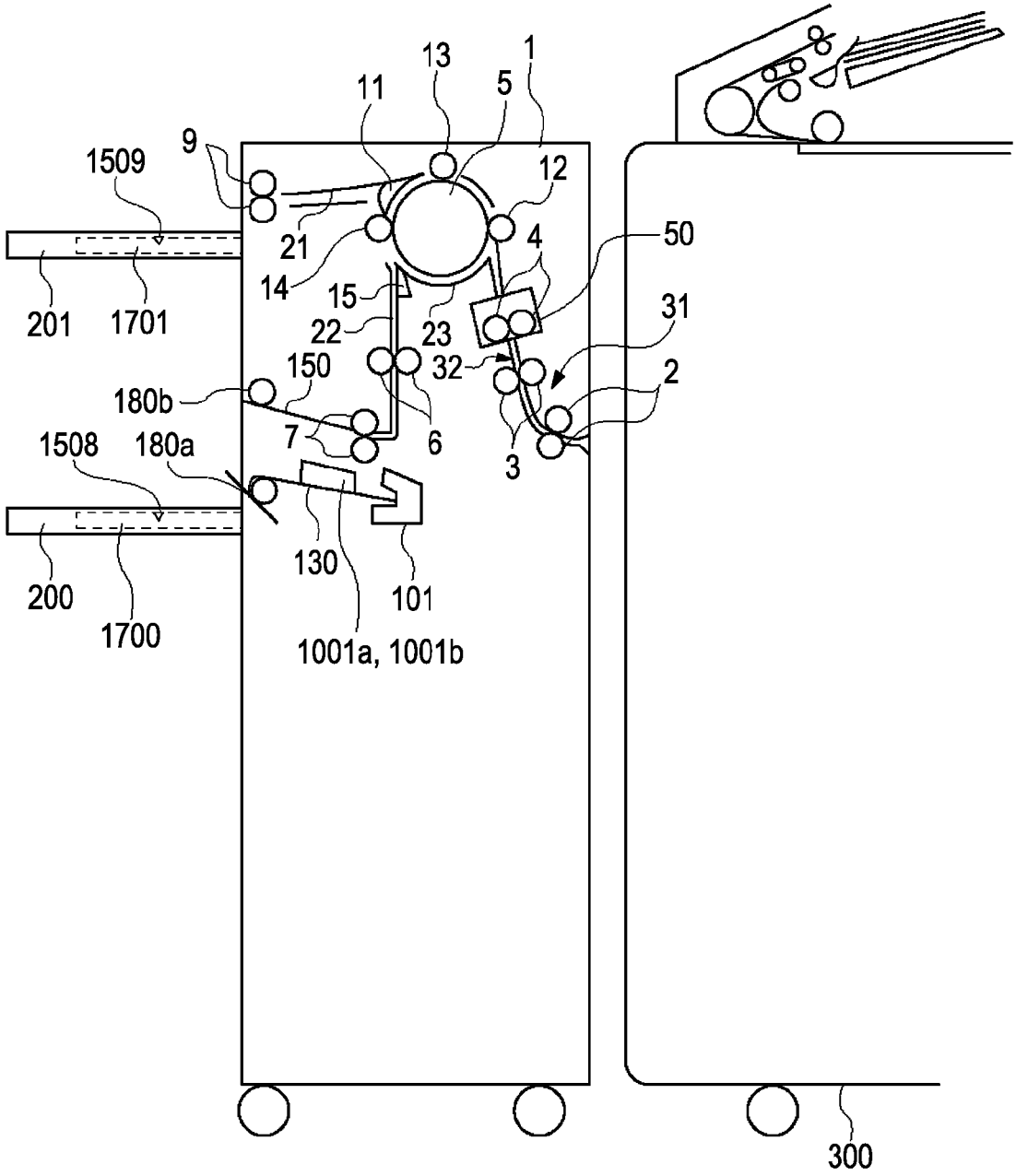
FIG. 1 is a cross-sectional view showing the schematic configuration of a sheet stacking apparatus according to an embodiment of the present invention.
Figure 2:
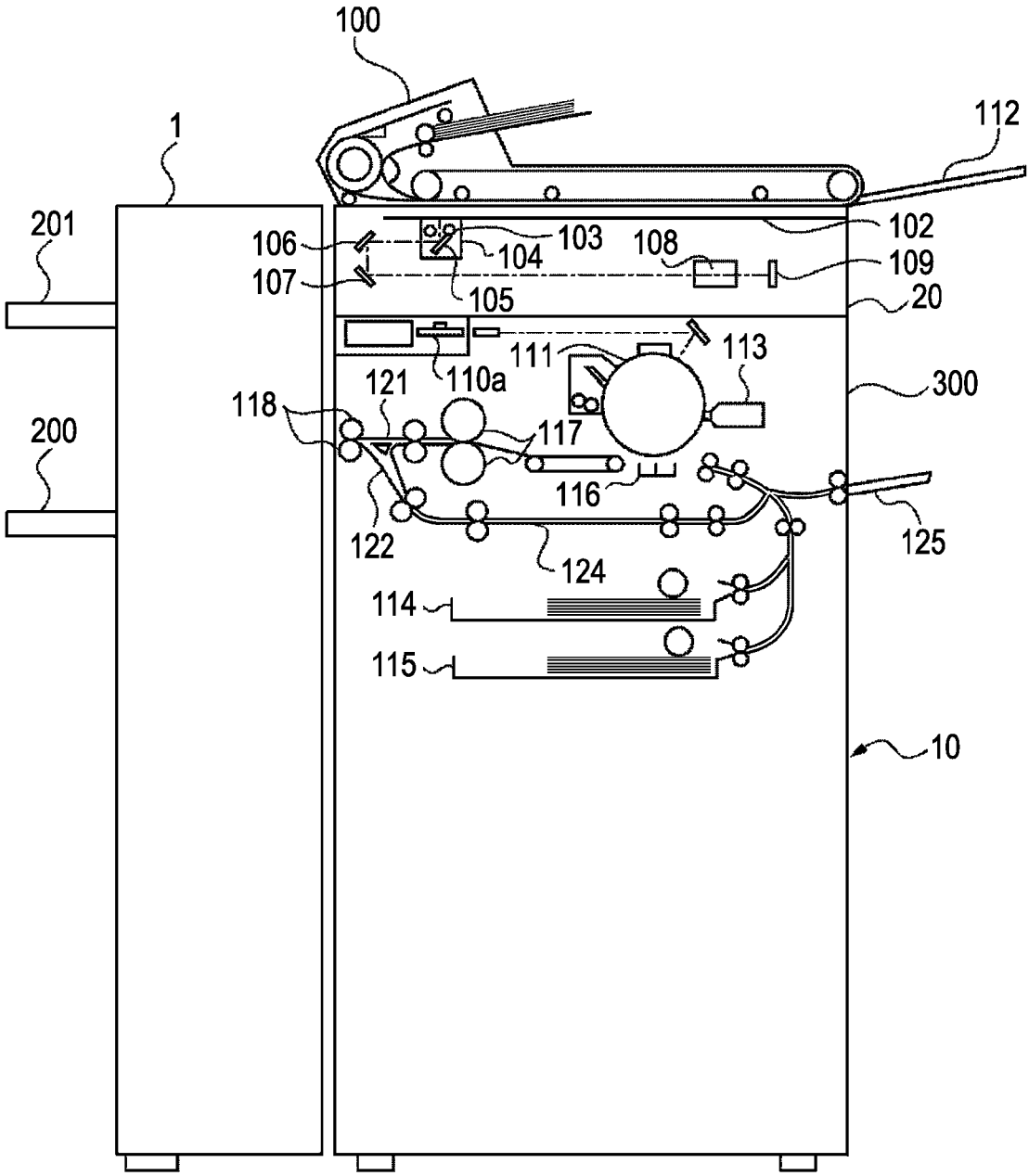
FIG. 2 is a cross-sectional view showing the schematic configuration of an image forming apparatus including the sheet stacking apparatus according to the embodiment of the present invention.

FIG. 1 shows a schematic configuration of a sheet processing apparatus into which a sheet stacking apparatus according to an embodiment of the present invention is incorporated. FIG. 2 shows a schematic configuration of a copier, as an image forming apparatus, that includes the sheet processing apparatus. While this embodiment concerns a case where the image forming apparatus is a copier that forms an image, the image forming apparatus is not limited thereto, and may be a printer, a facsimile, or the like that forms an image.

Overall Configuration of Image Forming Apparatus

Referring to FIG. 2, the image forming apparatus includes a body 10 and a finisher 1. The body 10 includes an image reader 20 that reads an image of an original and a printer 300.

The image reader 20 is mounted with an original feeder 100. The original feeder 100 feeds sheets of an original, which is set face up on an original tray, one by one from the top page in the leftward direction, conveys each sheet along a curved path and a platen glass 102 from left to right through a reading position, and discharges the sheet toward an external discharge tray 112. When an original passes through the reading position on the platen glass 102 from left to right, an image on the original is read by a scanner unit 104 held at a position corresponding to the reading position. Such a reading method is in general called moving original reading. Specifically, when an original passes through the reading position, a surface of the original that is to be read is irradiated with light emitted from a lamp 103 of the scanner unit 104, and the light reflected by the original is guided by mirrors 105, 106, and 107 to a lens 108. The light passes through the lens 108 and is incident on an image pickup surface of an image sensor 109, whereby an image is formed.

Scanning for original reading is performed while an original is conveyed through the reading position from left to right. Here, a direction orthogonal to a conveyance direction in which the original is conveyed is defined as a main scanning direction, and the conveyance direction is defined as a sub-scanning direction. Specifically, while an original is conveyed through the reading position in the sub-scanning direction, the image sensor 109 reads the image on the original line by line in the main scanning direction, whereby the entire image on the original is read. The image that has been optically read is converted by the image sensor 109 into image data and is output therefrom. The image data that has been output from the image sensor 109 is subjected to predetermined processings performed by an image signal control portion 303, which will be described separately below, and is input as a video signal to a printer control portion 304 of the printer 300.

Another original reading method so called stationary original reading is also available in which an original is conveyed by the original feeder 100 to a predetermined stop position on the platen glass 102 and, in this state, the scanner unit 104 is scanningly moved from left to right so as to read the original.

To read an original without using the original feeder 100, the original feeder 100 is first lifted by a user and an original is placed onto the platen glass 102. Subsequently, the scanner unit 104 is scanningly moved from left to right so as to read the original. In short, when an original is read without using the original feeder 100, stationary original reading is performed.

The printer control portion 304 of the printer 300 causes a laser beam to be emitted, the laser beam being modulated in accordance with the video signal that has been input to the printer control portion 304 from the image reader 20 or an external computer. The laser beam is scanningly moved by a polygonal mirror 110*a* in such a manner as to be applied to a photosensitive drum 111. In conformity with the scanning movement of the laser beam, an electrostatic latent image is formed on the photosensitive drum 111. In stationary original reading, the printer control portion 304 causes the laser beam to be emitted in such a manner as to form a normal image (an image that is not a mirror image).

The electrostatic latent image on the photosensitive drum 111 is visualized as a toner image by being supplied with toner from a developing unit 113, which in combination with the photosensitive drum 111 constitutes an image forming portion. With a timing synchronous with the start of laser beam application, a sheet is fed from any of sheet feeding units including cassettes 114 and 115, manual feeding unit 125, and a duplex conveyance path 124, into a nip between the photosensitive drum 111 and a transfer unit 116. The toner image formed on the photosensitive drum 111 is transferred by the transfer unit 116 onto the sheet that has been fed thereto.

The sheet carrying the toner image is further conveyed to a fusing unit 117. The fusing unit 117 fixes the toner image on the sheet by hot-pressing the sheet. The sheet that has passed through the fusing unit 117 is guided by the switching member 121 and discharge rollers 118 and is discharged from the printer 300 to the outside (to the finisher 1).

When a sheet is discharged with an image-carrying surface thereof face down, the sheet that has passed through the fusing unit 117 is guided by the switching member 121, which is turned accordingly, into a reversing path 122, where the sheet is temporarily held. Subsequently, after the trailing end of the sheet passes the switching member 121, the sheet is switched back and is discharged by the discharge rollers 118 from the printer 300. Such a discharge mode is hereinafter called reverse discharge. Reverse discharge is performed when images are formed by reading an original sequentially from the top page thereof, as in the case where images that are read through the original feeder 100 or images that are output from a computer are formed. In this mode, the sheets that have been discharged are arranged in the normal order.

When a hard sheet such as an overhead-projector (OHP) sheet is fed from the manual feeding unit 125 for image formation thereon, the sheet is directly discharged by the discharge rollers 118, without being guided into the reversing path 122, with a surface thereof on which an image is to be formed face up.

When duplex recording in which images are formed on both sides of a sheet is effective, the sheet is guided by the switching member 121, which is turned accordingly, into the reversing path 122 and is then conveyed to the duplex conveyance path 124. Subsequently, it is controlled to feed the sheet residing in the duplex conveyance path 124 again into the nip between the photosensitive drum 111 and the transfer unit 116 with the aforementioned timing.

Thus, the sheet that has been discharged from the printer 300 while carrying an image formed thereon is conveyed to the finisher 1.

Description of Sheet Processing Apparatus

FIG. 1 shows the finisher 1, as a sheet processing apparatus including the sheet stacking apparatus according to the embodiment of the present invention, and the printer 300. Detailed description of the printer 300 is omitted here. The finisher 1 is connected to the printer 300 on a side (the downstream side in the conveyance direction) of the printer 300. A sheet that has been discharged from the printer 300 is processed according to need or is conveyed without being processed, and is stacked onto a first tray 201 or a second tray 200. Herein, a side of the image forming apparatus having an operation portion 308, described separately below, with which the user makes various inputs and settings to the body 10 of the image forming apparatus is defined as the front side of the image forming apparatus, and the opposite side of the apparatus is defined as the rear side.

The finisher 1 includes the following: a pair of entrance rollers 2, pairs of conveying rollers 3 and 4 movable orthogonally to the conveyance direction, a sheet detection sensor 31, a lateral-registration detection sensor 32 that detects a lateral end of the sheet extending in the conveyance direction, a punching unit 50 that punches the sheet conveyed thereto at a position near the trailing end of the sheet, a large conveying roller 5, pressing rollers 12 to 14 that convey the sheet while pressing the sheet against the large conveying roller 5, and a switching member 11 that is driven by a switching solenoid SL10 (FIG. 4) and with which switching between a non-sorting path 21 and a sorting path 22 is performed. The sheet that has passed through the sorting path 22 is discharged and is stacked onto the first tray 201. The first tray 201, corresponding to a first stacking tray, is removably placed on a plurality (two in this embodiment) of first-tray arms 1701, corresponding to sub-members of a first supporting member. The first-tray arms 1701 are provided at a predetermined interval, thereby supporting the first tray 201. In response to the driving of a first-tray motor M13 (FIG. 4), corresponding to a moving portion, the first-tray arms 1701 are moved, whereby the first tray 201 can be raised and lowered. The finisher 1 also includes the following: a switching member 15 with which switching between a buffer path 23, which temporarily receives a sheet thereon, and the sorting path 22 is performed, an intermediate processing tray 130 on which sheets are temporarily collected, conveying rollers 6, and discharge rollers 7 that discharge a sheet onto the processing tray 130. The processing tray is provided therearound with a pair of a front alignment plate 1001*a* and a rear alignment plate 1001*b*, with which alignment in a direction (sheet width direction) orthogonal to the sheet conveyance direction is performed, and a stapling unit 101, corresponding to a sheet processing portion, capable of stapling the collected sheets. Home positions (HP) of the front alignment plate 1001*a*, the rear alignment plate 1101*b*, and the stapling unit 101 can be detected by a front-alignment-plate HP sensor 1501, a rear-alignment-plate HP sensor 1502, and a stapling-unit HP sensor 1500, respectively, shown in FIG. 4. The front aligning plate 1001*a* and the rear aligning plate 1001*b*, which are movable in the anteroposterior direction (sheet width direction) of the apparatus, and the stapling unit 101 are driven by a front alignment motor M12, a rear alignment motor M11, and a stapling-unit-sliding motor M10 (FIG. 4), respectively. The finisher 1 also includes a swing guide and an upper sheet-stack-discharge roller 180*b* supported by the swing guide 150. When the swing guide 150 is in a closed position, the upper sheet-stack-discharge roller 180*b* works in combination with a lower sheet-stack-discharge roller 180*a* provided to the processing tray 130, so as to convey and discharge a sheet stack on the processing tray to the second tray (a sheet stacking portion) 200. The lower sheet-stack-discharge roller 180*a* and the upper sheet-stack-discharge roller 180*b* constitute a pair of sheet-stack-discharge rollers that discharges a sheet stack on the processing tray 130 onto the second tray 200. The second tray 200, corresponding to a second stacking tray, is arranged along the same moving area in which the first tray 201 is movable. The second tray 200 is removably placed on a plurality (two in this embodiment) of second-tray arms 1700, corresponding to sub-members of a second supporting member. The second-tray arms 1700 are provided at a predetermined interval, thereby supporting the second tray 200. In response to the driving of a second-tray motor M14 (FIG. 4), corresponding to the moving portion, the second-tray arms 1700 are moved, whereby the second tray 200 can be raised and lowered.

Figure 5:
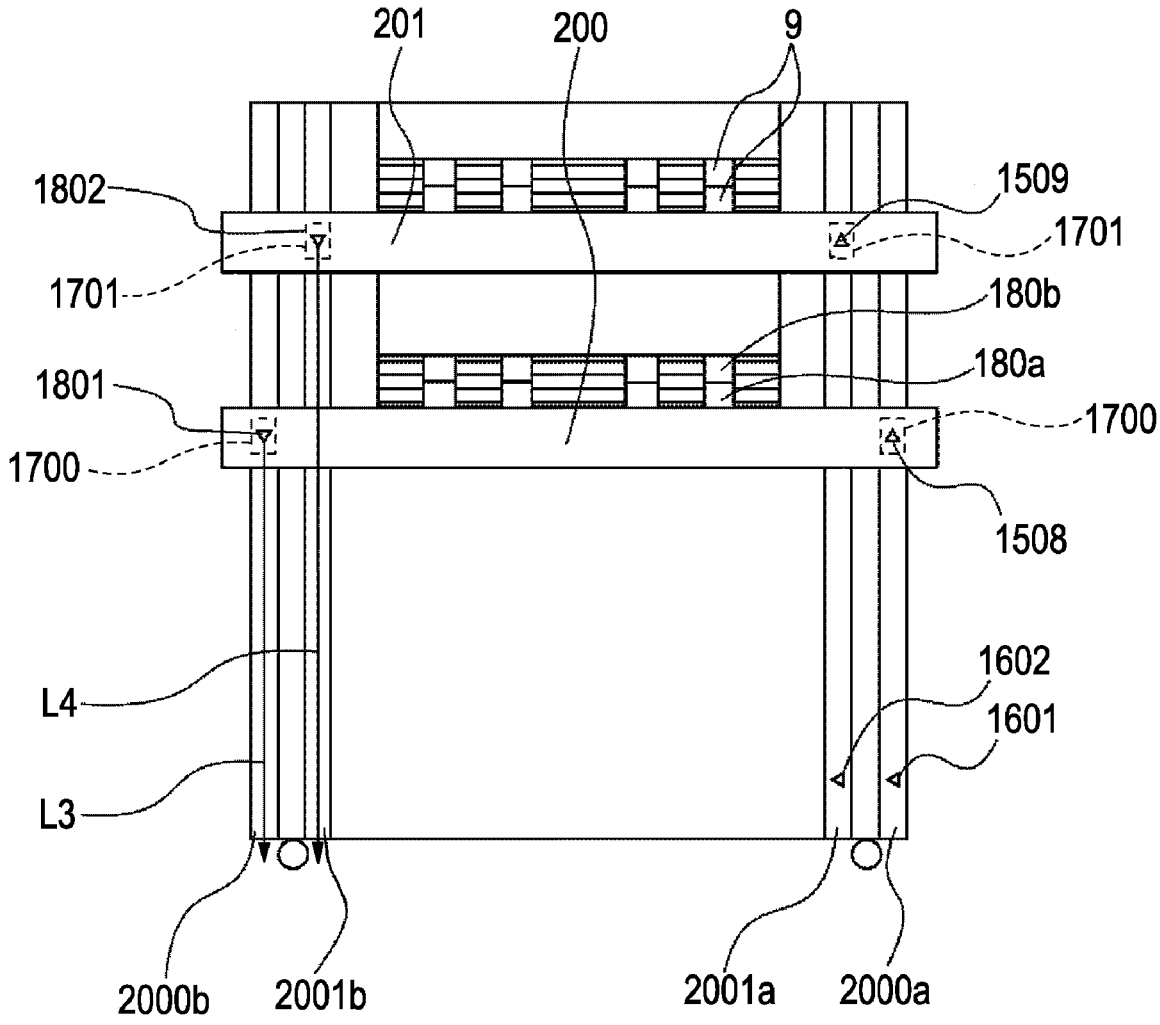
FIG. 5 is a side view of the sheet stacking apparatus according to the embodiment of the present invention.

FIG. 5 shows the finisher 1 viewed from the downstream side in the conveyance direction.

The second-tray arms 1700 carrying the second tray 200 are fitted in posts 2000*a* and 2000*b* in such a manner as to be movable up and down. Likewise, the first-tray arms 1701 carrying the first tray 201 are fitted in posts 2001*a* and 2001*b* in such a manner as to be movable up and down. The posts 2000*a* and 2001*a* are provided with a second-tray-full-state detection sensor 1601 and a first-tray-full-state detection sensor 1602, respectively, that each detects a state in which the number of sheets on the corresponding tray has reached the maximum stackable number. One of the second-tray arms 1700 and one of the first-tray arms 1701 have therein a second-tray-removal detection sensor 1508 and a first-tray-removal detection sensor 1509, respectively, that each detect whether or not the corresponding tray is present thereon.

Figure 6:
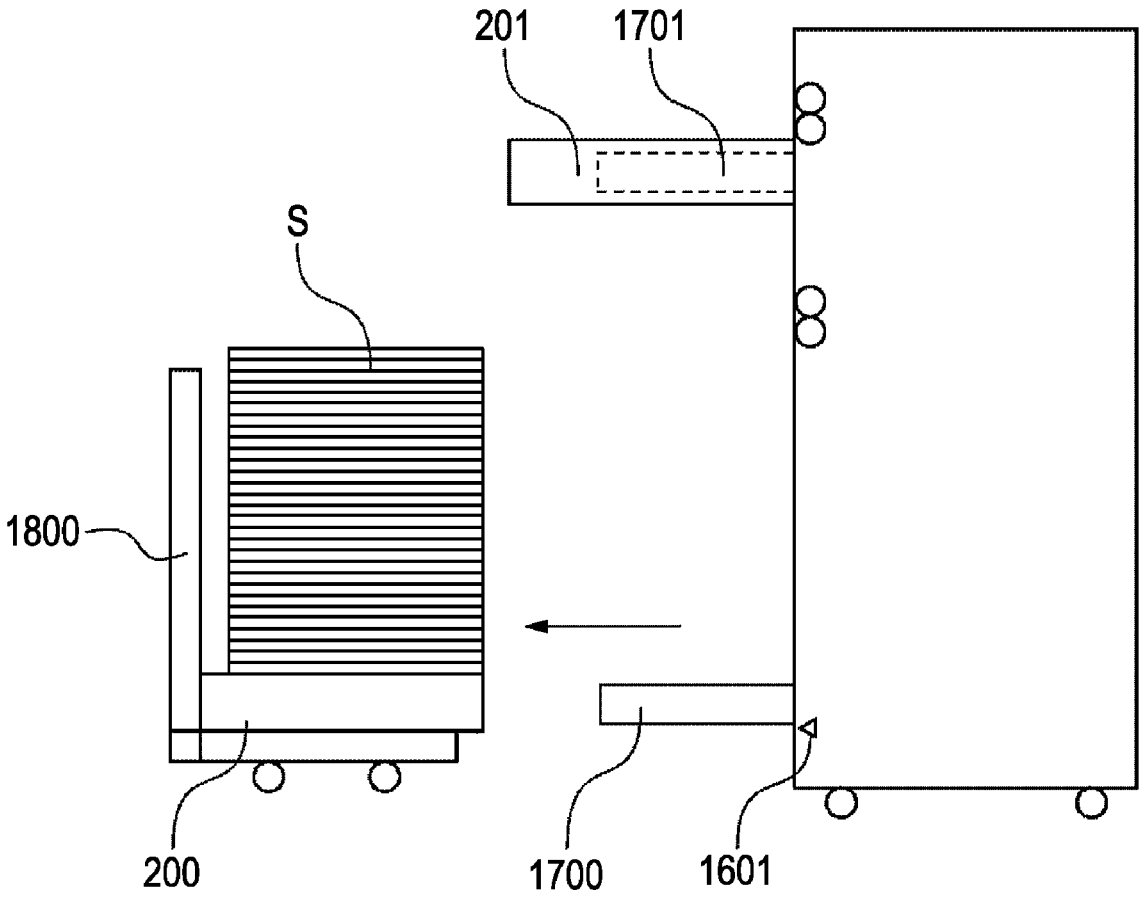
FIG. 6 is a front view of the sheet stacking apparatus according to the embodiment of the present invention.

FIG. 6 shows a state where the second tray 200 can be removed by using a dolly 1800. When the second-tray-full-state detection sensor 1601 detects a state where the number of sheets included in a sheet stack S on the second tray 200 has reached the maximum, the dolly 1800 is placed below the second tray 200, and the second tray 200 is secured to the dolly 1800. Thus, the second tray 200 is removed.

Next, a configuration enabling the second-tray arms 1700 and the first tray 201 to pass each other, i.e., a configuration enabling position switching therebetween, will be described.

Figure 7:
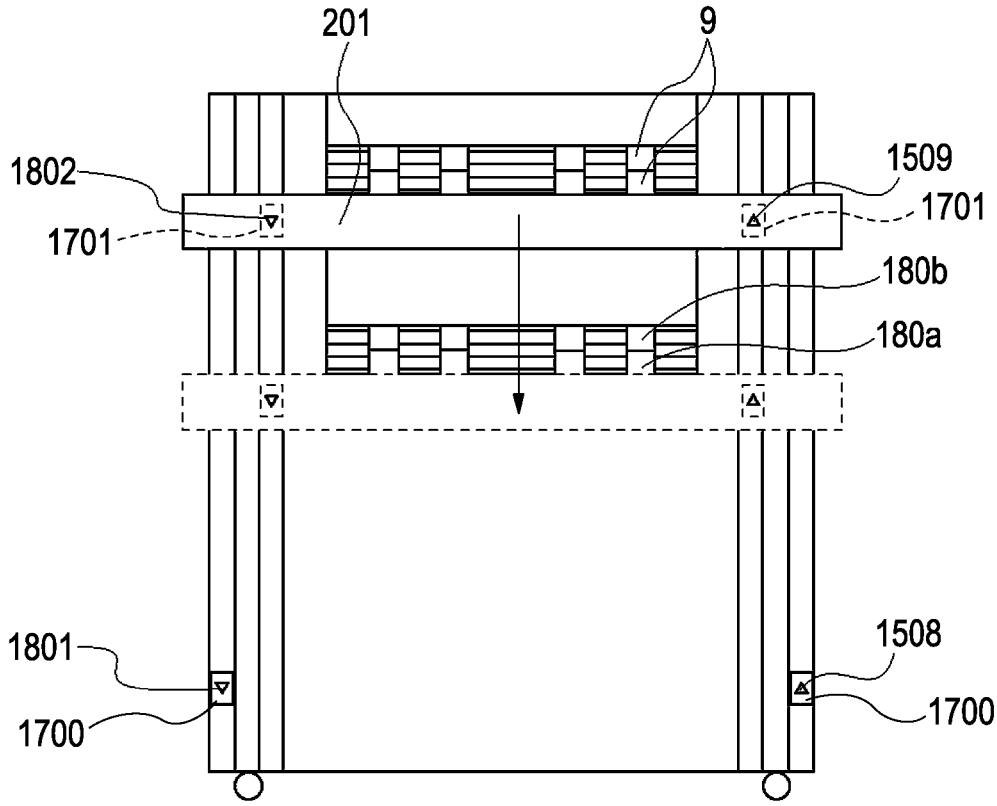
FIG. 7 is another side view of the sheet stacking apparatus according to the embodiment of the present invention.
Figure 8:
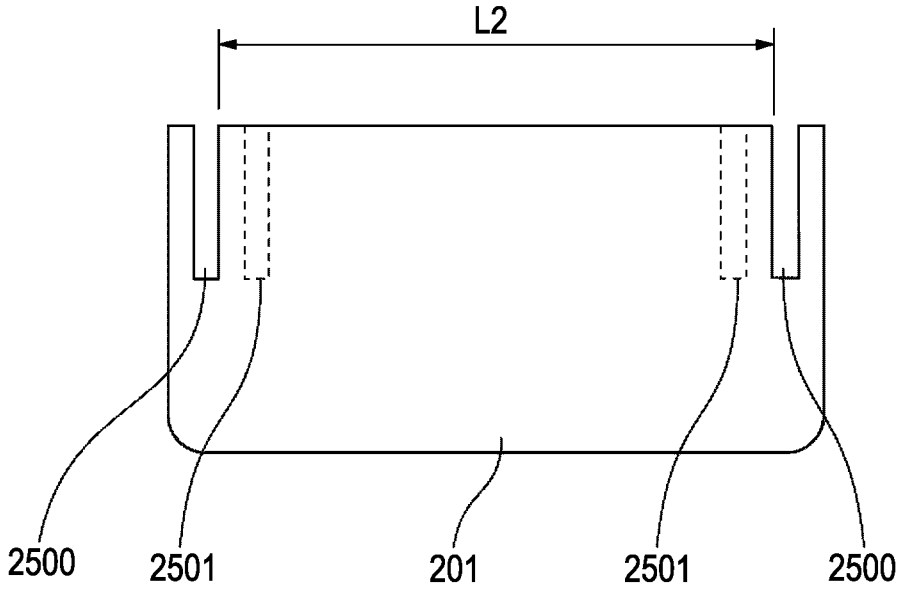
FIG. 8 is a top view of a tray according to the embodiment of the present invention.

FIG. 7 shows the finisher 1 viewed from the downstream side in the conveyance direction, with the second tray 200 removed from the second-tray arms 1700. FIG. 8 is a top view of the first tray 201.

Referring to FIG. 8, the first tray 201 has notches 2500 allowing the second-tray arms 1700 to pass therethrough. The first tray 201 also has arm-receiving recesses 2501 in which the first-tray arms 1701 are received. The width and length of and the interval between the notches 2500 are determined in such a manner that a sufficient strength of the first tray 201 is obtained and that no interference occurs between the first tray 201 carrying a stack of sheets and the second-tray arms 1700.

After the first tray 201 is lowered as indicated by the arrow shown in FIG. 7 to a position (shown in broken lines) below a lower discharge port, referring then to FIG. 9, the second-tray arms 1700 not having the second tray 200 thereon are raised while passing through the notches 2500, whereby switching positions with the first tray 201.

Figure 10:
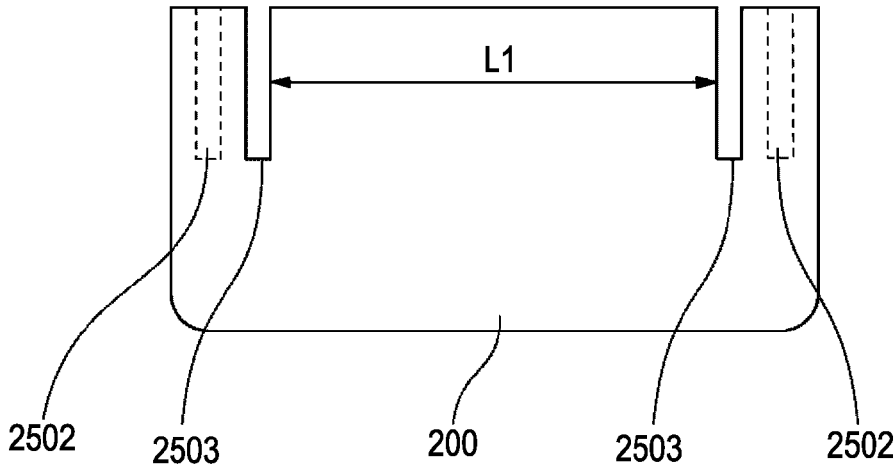
FIG. 10 is a top view of another tray according to the embodiment of the present invention.

Referring to FIG. 10, the second tray 200 has notches 2503 allowing the first-tray arms 1701 to pass therethrough. The second tray 200 also has arm-receiving recesses 2502 in which the second-tray arms 1700 are received. With such a configuration, as in the case of position switching between the first tray 201 and the second-tray arms 1700, the first-tray arms 1701 not having the first tray 201 thereon and the second tray 200 can pass and switch positions with each other.

Figure 9:
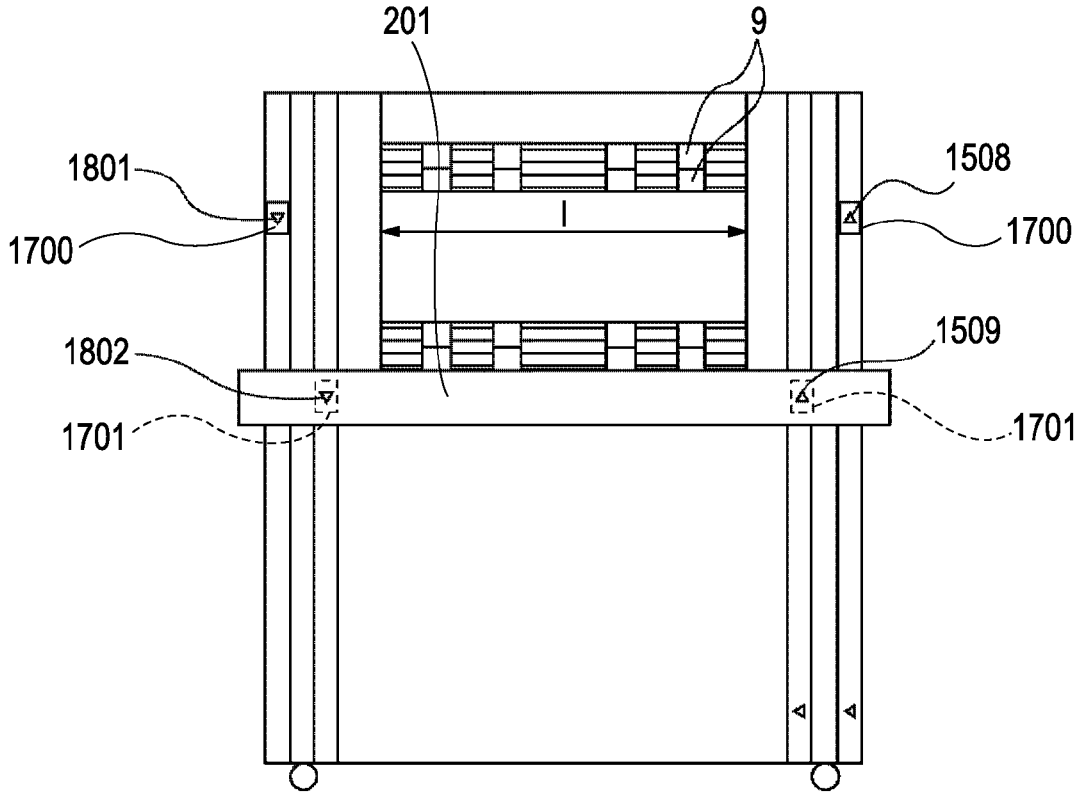
FIG. 9 is another side view of the sheet stacking apparatus according to the embodiment of the present invention.

The notches 2500 shown in FIG. 8 and the notches 2503 shown in FIG. 10 are arranged, in the sheet width direction, outside the range of the sheet discharge port, through which a sheet having the maximum stackable width can pass, as shown in FIG. 9. Specifically, an inner interval L2 between the notches 2500 and an inner interval L1 between the notches 2503 are larger than a length 1 of the sheet discharge port in the sheet width direction. Therefore, either tray carrying a stack of sheets having the maximum width can pass and switch positions with the tray arms provided for the other tray but not having the tray. Although this embodiment concerns a case where L1<L2, L1 and L2 may be equal to each other as long as the notches 2500 and 2503 are both positioned outside the range of the length 1 of the sheet discharge port and are arranged at positions staggered in the sheet width direction. Moreover, if it is acceptable that the positions of the trays are staggered in the sheet width direction in a state where the trays are placed on the respective tray arms, the trays may be provided in a common form. The tray arms, as the first and second supporting members, for the respective trays are arranged at positions staggered in the sheet width direction, which is orthogonal to a direction in which the trays are movable, and therefore will not interfere with each other while the positions thereof are switched.

Control Block Diagram

Next, the configuration of a control device 950 that controls the entirety of the image forming apparatus will be described with reference to FIG. 3.

Figure 3:
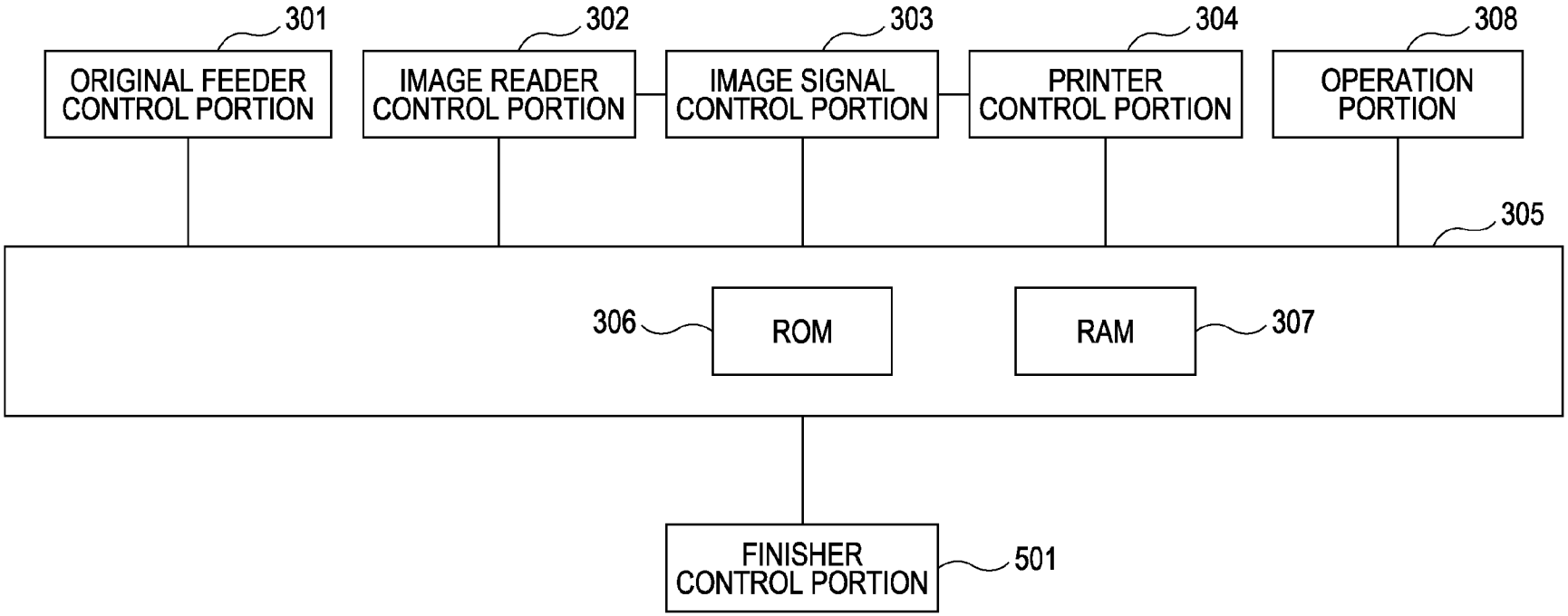
FIG. 3 is a block diagram showing the overall system configuration of the image forming apparatus.

FIG. 3 is a block diagram showing the configuration of the control device 950 included in the printer 300.

Referring to FIG. 3, the control device 950 includes a central-processing-unit (CPU) circuit portion 305. The CPU circuit portion 305 includes a CPU (not shown), a read-only memory (ROM) 306, and a random access memory (RAM) 307, and generally controls various blocks 301, 302, 303, 304, 308, and 501 in accordance with control programs stored in the ROM 306. The RAM 307 temporarily holds control data and is used as a workspace for arithmetic processings accompanying the control operation. An original feeder control portion 301 controls the driving of the original feeder 100 in accordance with an instruction issued by the CPU circuit portion 305. An image reader control portion 302 controls the driving of the light source (lamp 103), the lens 108, the image sensor 109, and so forth, thereby transferring an image signal, which is output from the image sensor 109, to the image signal control portion 303.

The image signal control portion 303 performs various processings to the image signal output from the image sensor 109, converts the image signal, which is a digital signal, into a video signal, and outputs the video signal to the printer control portion 304. The processings performed by the image signal control portion 303 are controlled by the CPU circuit portion 305.

The operation portion 308 includes a plurality of keys with which various parameters on image formation are set, a display 308*a* on which the set parameters are displayed, and so forth. The operation portion 308 outputs key signals corresponding to respective key operations to the CPU circuit portion 305, and displays on the display 308*a* information obtained in accordance with signals from the CPU circuit portion 305.

Figure 4:
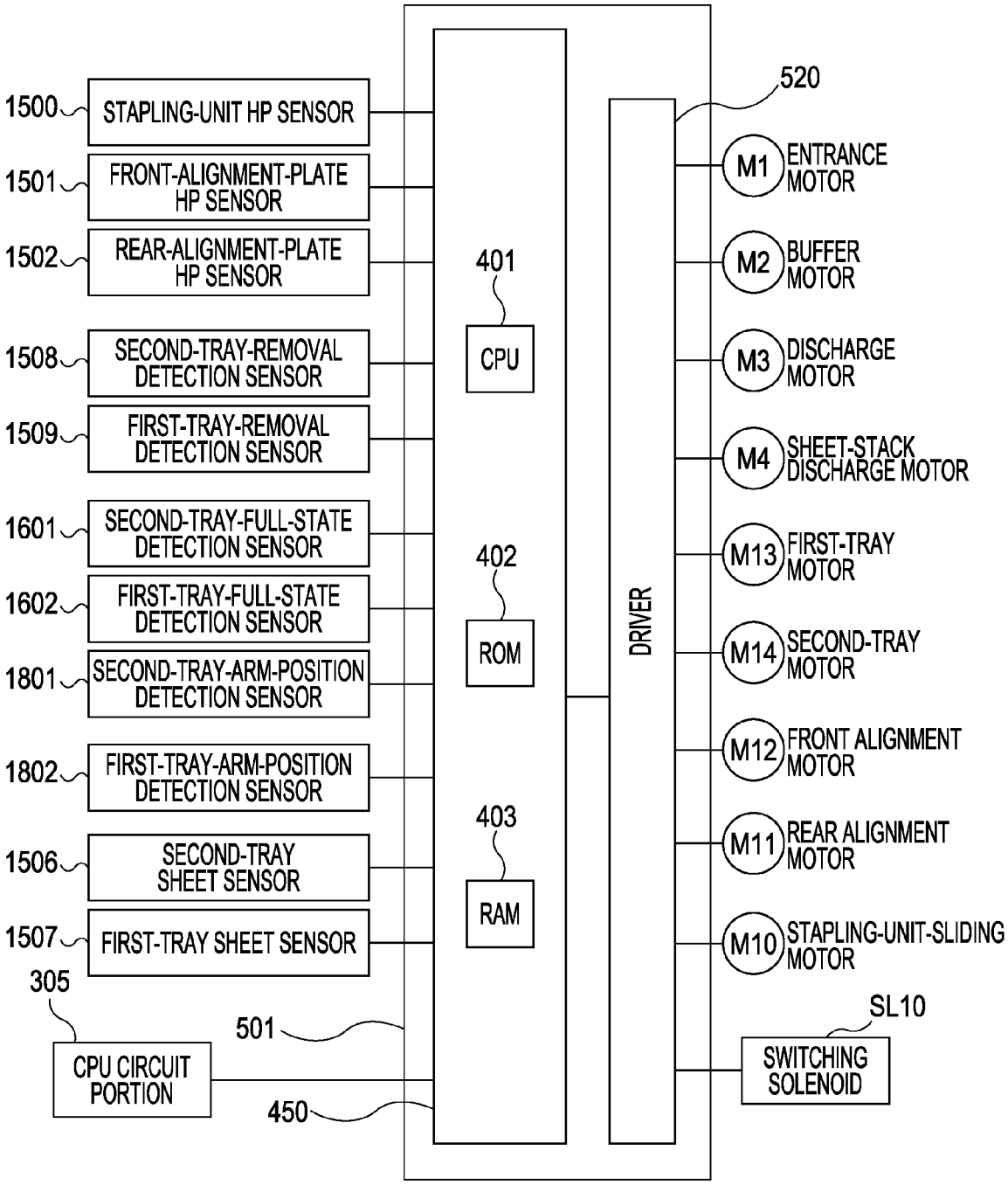
FIG. 4 is a block diagram showing the system configuration of the sheet stacking apparatus according to the embodiment of the present invention.

FIG. 4 is a block diagram showing the configuration of a finisher control portion 501, corresponding to a control portion.

The finisher control portion 501 is included in the finisher 1 and includes, referring to FIG. 4, a CPU circuit portion 450 constituted by a CPU 401, a ROM 402, a RAM 403, and so forth. The CPU circuit portion 450 communicates with the CPU circuit portion 305 included in the body 10 of the image forming apparatus via a communication integrated circuit (IC) (not shown), and performs data conversion. In accordance with instructions issued by the CPU circuit portion 450, various programs stored in the ROM 402 are performed. Thus, the CPU circuit section 450 controls the driving of the finisher 1. The CPU circuit portion 450 also includes a jam timer (not shown) that detects the occurrence of a jam.

In the control operation of driving the finisher 1, detection signals from various sensors are input to the CPU circuit portion 450. Such sensors include the following: the stapling-unit HP sensor 1500 that detects the home position of the stapling unit 101, the front-alignment-plate HP sensor 1501 and the rear-alignment-plate HP sensor 1502 that detect the respective home positions of the front alignment plate 1001*a* and the rear alignment plate 1001*b*, the second-tray-removal detection sensor 1508 that detects whether or not the second tray 200 has been removed from the second-tray arms 1700, the first-tray-removal detection sensor 1509 that detects whether or not the first tray 201 has been removed from the first-tray arms 1701, the second-tray-full-state detection sensor 1601 that detects the full state of the second tray 200, the first-tray-full-state detection sensor 1602 that detects the full state of the first tray 201, a second-tray-arm-position detection sensor 1801 that detects the position of the second tray 200, a first-tray-arm-position detection sensor 1802 that detects the position of the first tray 201, a second-tray sheet sensor 1506 that detects the presence of any sheets stacked on the second tray 200, and a first-tray sheet sensor 1507 that detects the presence of any sheets stacked on the first tray 201.

A driver 520 is connected to the CPU circuit portion 450. The driver 520 drives various motors, solenoids, and clutches in accordance with signals from the CPU circuit portion 450.

The motors include an entrance motor M1 as the drive source of the pair of entrance rollers 2 and the pairs of conveying rollers 3 and 4, a buffer motor M2 as the drive source of the large conveying roller 5, a discharge motor M3 as the drive source of a pair of conveying rollers 6 and pairs of discharge rollers 7 and 9, a sheet-stack discharge motor M4 as the drive source of the upper and lower sheet-stack-discharge rollers 180*a* and 180*b*, the first-tray motor M13 as the drive source of the first tray 201, the second-tray motor M14 as the drive source of the second tray 200, the front alignment motor M12 as the drive source of the front alignment plate 1001*a*, the rear alignment motor M11 as the drive source of the rear alignment plate 1001*b*, the stapling-unit-sliding motor M10 as the drive source that slides the stapling unit 101, and so forth. These motors are stepping motors and can cause the pairs of rollers driven therewith to rotate at the same speed or at individual speeds by controlling the respective excitation pulse rates. Further, the motors can be driven by the driver 520 in such a manner as to rotate in the normal and reverse directions.

The solenoids include the switching solenoid SL10 that turns the switching member 11.

Description of Sheet Discharging Operation to First or Second Stacking Tray

The operation in which a sheet discharged from the printer 300 is stacked onto the first tray 201 or the second tray 200 will be described in due order.

The operation of conveying a sheet to the first tray 201 will first be described with reference to FIG. 1.

To convey a sheet to the first tray 201, the finisher 1 turns the switching member 11 so as to switch the conveyance path from the sorting path 22 to the non-sorting path 21. The sheet that has been discharged from the printer 300 is conveyed through the pair of entrance rollers 2 and the pairs of conveying rollers 3 and 4, is guided while being pressed by the pressing rollers 12 to 14 against the large conveying roller 5 into the non-sorting path 21, and is discharged by the pair of discharge rollers 9 for non-sorting onto the first tray 201.

Next, the operation of conveying a sheet to the second tray 200 will be described.

Each of sheets that have been individually discharged from the printer 300 is conveyed through the pair of entrance rollers 2 and pairs of conveying rollers 3 and 4, is guided while being pressed by the pressing rollers 12 to 14 against the large conveying roller 5 into the sorting path 22, is conveyed by the pair of conveying rollers 6, and is discharged by the pair of discharge rollers 7 onto the processing tray 130.

Subsequently, the sheets are aligned by the front and rear alignment plates 1001*a* and 1101*b* in the sheet width direction, are stapled by the stapling unit 101 depending on the user setting, and are discharged as a sheet stack by the upper and lower sheet-stack-discharge rollers 180*a* and 180*b* onto the second tray 200.

Description of Tray Position Detection

Whether or not tray position switching have been completed, that is, whether or not the positional relationship between the trays has been reversed, is determined in accordance with the result of detection of the heights at which the respective trays that are being moved are positioned.

Referring to FIG. 5, the second-tray-arm-position detection sensor 1801 that detects the position of the second tray 200 and the first-tray-arm-position detection sensor 1802 that detects the position of the first tray 201 are distance-measuring sensors that detect distances (L3 and L4) from the respective trays to the floor surface where the finisher 1 is set up. If tray positions are switched, the magnitude relationship between the distance detected by the second-tray-arm-position detection sensor 1801, corresponding to a position detector, and the distance detected by the first-tray-arm-position detection sensor 1802, also corresponding to the position detector, will change. Thus, the vertical positional relationship between the trays can be identified.

Description of Control Operation of Tray Position Switching

Figure 11:
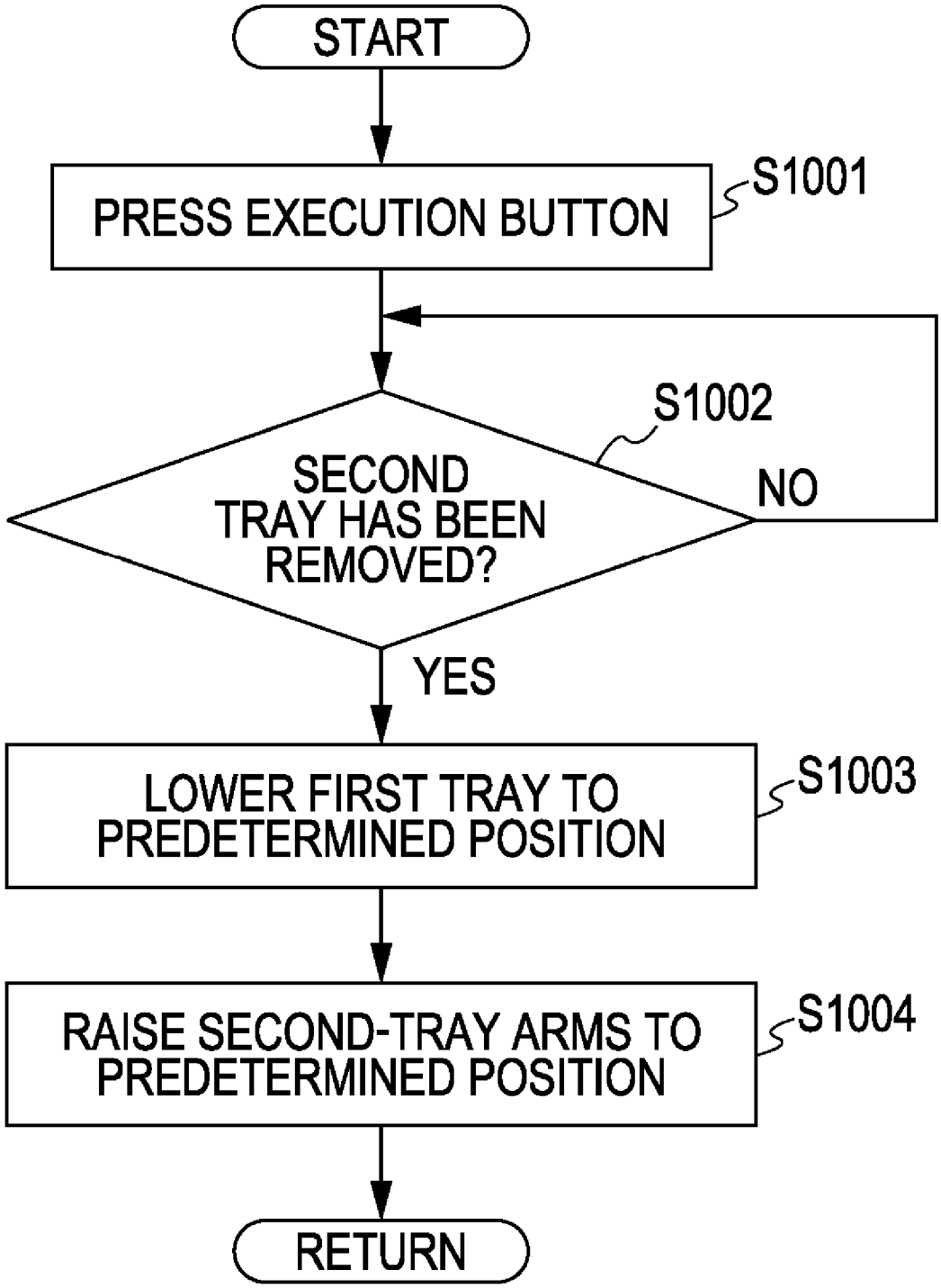
FIG. 11 is a flowchart showing a control operation of tray position switching according to the embodiment of the present invention.

To remove sheets stacked on a tray onto which sheets are still being stacked, tray position switching can be performed at any time. In such a case, the downtime of the sheet stacking operation that elapses while removing the sheets needs to be reduced. In this respect, the tray positions after position switching are set in such a manner that the tray that has been at a lower position is raised to a stackable position and the tray that has been at an upper position is lowered to a sheet removing position. The control operation performed in such tray position switching will be described with reference to the flowchart shown in FIG. 11.

To remove sheets stacked on the stacking tray at the upper position, in step S1001, a tray-position-switching execution button provided on the operation portion 308 is pressed, whereby an instruction to perform tray position switching is issued. In subsequent step S1002, the CPU circuit portion 450 checks whether or not the second tray 200, the lower one, has been removed in accordance with a detection signal of the second-tray-removal detection sensor 1508, corresponding to a tray detector. If it is determined that the second tray 200, the lower one, has been removed, in subsequent step S1003, the CPU circuit portion 450 drives the first-tray motor M13 so as to lower the first tray 201, the upper one, to a predetermined position (the sheet removing position). Then, in step S1004, the CPU circuit portion 450 drives the second-tray motor M14 so as to raise the second-tray arms 1700 to a predetermined position (the stackable position). The maximum numbers of sheets stackable on the respective trays are set in such a manner that the predetermined position to which the second-tray arms 1700 are raised for tray position switching is higher than the top surface of the sheet stack on the first tray 201 that has been lowered to the predetermined position. In addition, the lowering of the first tray 201 and the raising of the second-tray arms 1700 may be performed simultaneously or one after the other, regardless of the order, as long as both are performed after the removal of the second tray 200, the lower one, is detected.

In this manner, the positions of the vertically arranged trays are switched so that the tray at the upper position having sheets thereon is lowered to the sheet removing position. Then, the sheets are carried with the dolly 1800 shown in FIG. 6. Meanwhile, the other tray is placed on the corresponding tray arms that have been raised to the stackable position as a result of tray position switching. Thus, the sheet stacking operation can be continued. By sequentially repeating the above-described operations for tray position switching, a large number of sheets can be discharged by reducing downtime caused by stopping the sheet stacking operation.

Figure 12:
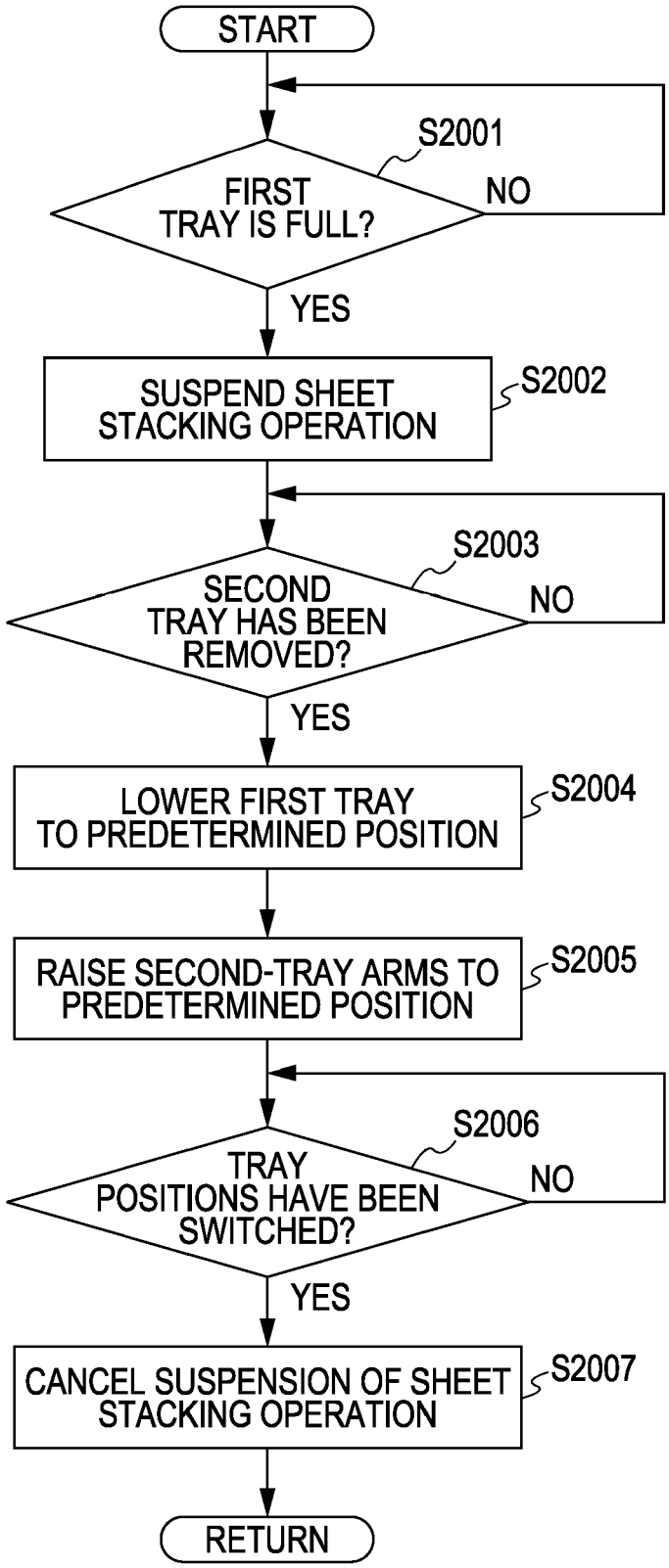
FIG. 12 is a flowchart showing a control operation of tray position switching according to the embodiment of the present invention after the detection of the maximum stackable number of sheets.

Description of Control Operation of Tray Position Switching After Detection of Maximum Stackable Number of Sheets To reduce the downtime of the sheet stacking operation without pressing the tray-position-switching execution button, an instruction to perform tray position switching is automatically issued after it is detected that the number of stacked sheets has reached the maximum stackable number. The control operation performed in such tray position switching will be described with reference to the flowchart shown in FIG. 12.

As the number of sheets stacked on the first tray 201 increases, the first-tray arms 1701 are gradually lowered. In step S2001, the first-tray-full-state detection sensor 1602, corresponding to a height detector, detects whether or not the height of the sheet stack has reached a predetermined stacking height so that it is checked whether or not the first tray 201 is full. If it is determined that the first tray 201 is full, the CPU circuit portion 450 included in the finisher control portion 501 transmits to the CPU circuit portion 305 included in the control device 950 information that the number of sheets stacked on the first tray 201 has reached the maximum stackable number. In subsequent step S2002, the CPU circuit portion 450 suspends the image forming operation performed by the printer 300 and the sheet stacking operation performed by the finisher 1.

Then, in step S2003, the CPU circuit portion 450 checks whether or not the second tray 200 has been removed, by monitoring the signal of the second-tray-removal detection sensor 1508, corresponding to the tray detector. If the removal of the second tray 200 is detected, in subsequent step S2004, the CPU circuit portion 450 drives the first-tray motor M13 so as to lower the first tray 201 to the predetermined position (the sheet removing position). Further, in step S2005, the CPU circuit portion 450 drives the second-tray motor M14 so as to raise the second-tray arms 1700 to the predetermined position (the stackable position).

In step S2006, the CPU circuit portion 450 checks, in accordance with the results of detections performed by the second-tray-arm-position detection sensor 1801 and the first-tray-arm-position detection sensor 1802, whether or not the vertical positional relationship between the second-tray arms 1700 and the first tray 201 has been reversed. If it is determined that the positional relationship has been reversed, then in step S2007, the CPU circuit portion 450 transmits to the CPU circuit portion 305 of the control device 950 information that the image forming operation can be restarted, and cancels the suspension of the image forming operation in the printer 300 and the suspension of the sheet stacking operation in the finisher 1. By performing tray position switching as described above and repeating the above-described removal of sheets and placement of the trays, a large number of sheets can be discharged by reducing downtime caused by stopping the sheet stacking operation.

Figure 13:
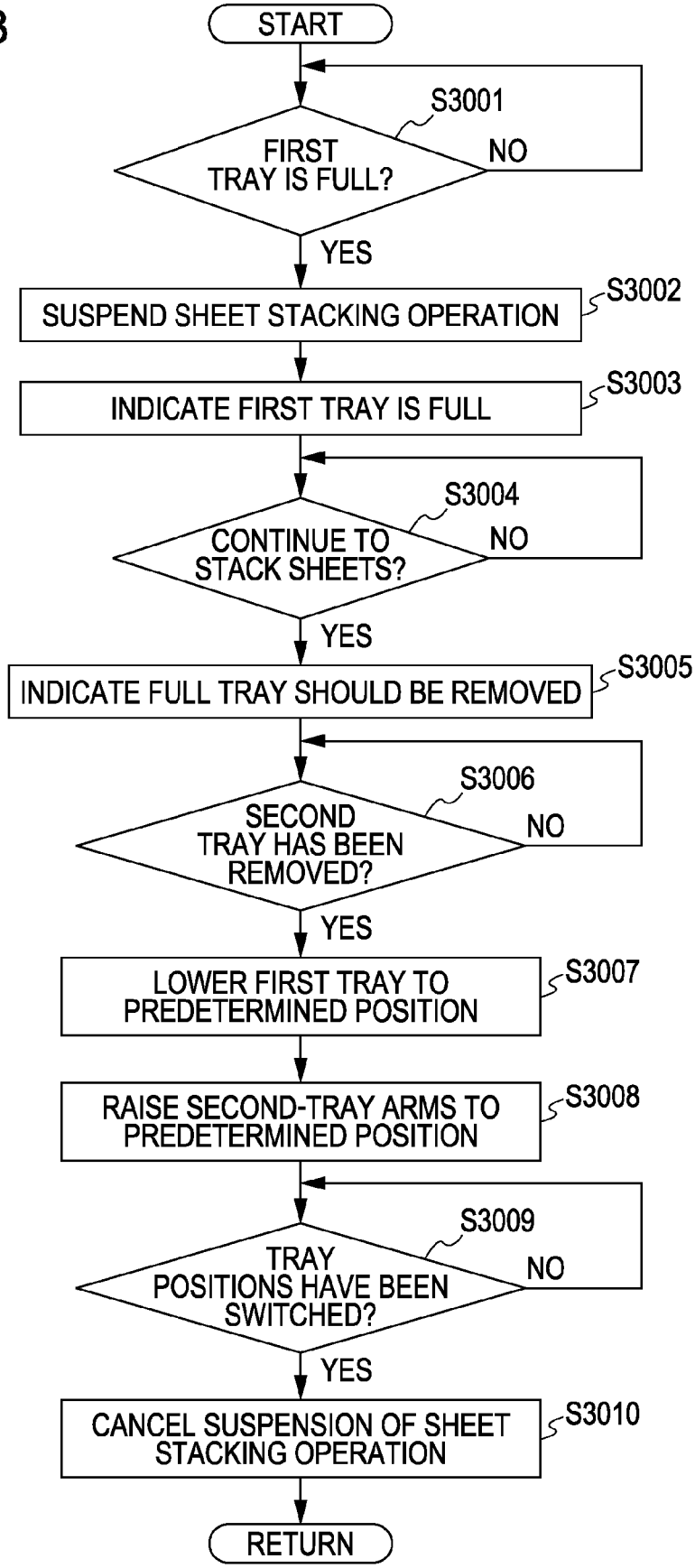
FIG. 13 is a flowchart showing a control operation of causing a message to be displayed on an operation portion.

Description of Another Embodiment Concerning Control Operation of Tray Position Switching After Detection of Maximum Stackable Number of Sheets Next, another embodiment of the control operation performed in tray position switching after the detection of the maximum stackable number of sheets will be described with reference to FIGS. 13 to 15. In this operation, relevant messages are displayed on the display 308*a*. In the foregoing control operation performed in tray position switching after the detection of the maximum stackable number of sheets, the tray at the lower position will not be removed before the user notices that the tray at the upper position is full. In this embodiment, the image forming apparatus proactively gives the user notice that the tray at the upper position is full.

This operation will be described with reference to the flowchart shown in FIG. 13. As sheets discharged from the printer 300 continue to be stacked onto the first tray 201, the first-tray arms 1701 are gradually lowered. In step S3001, the first-tray-full-state detection sensor 1602 detects whether or not the height of the sheet stack has reached a predetermined stacking height so that it is checked whether or not the first tray 201 is full. If it is determined that the first tray 201 is full, the CPU circuit portion 450 transmits to the CPU circuit portion 305 of the control device 950 information that the number of sheets stacked on the first tray 201 has reached the maximum stackable number. In subsequent step S3002, the CPU circuit portion 450 suspends the image forming operation performed by the printer 300 and the sheet stacking operation performed by the finisher 1.

Figure 14:
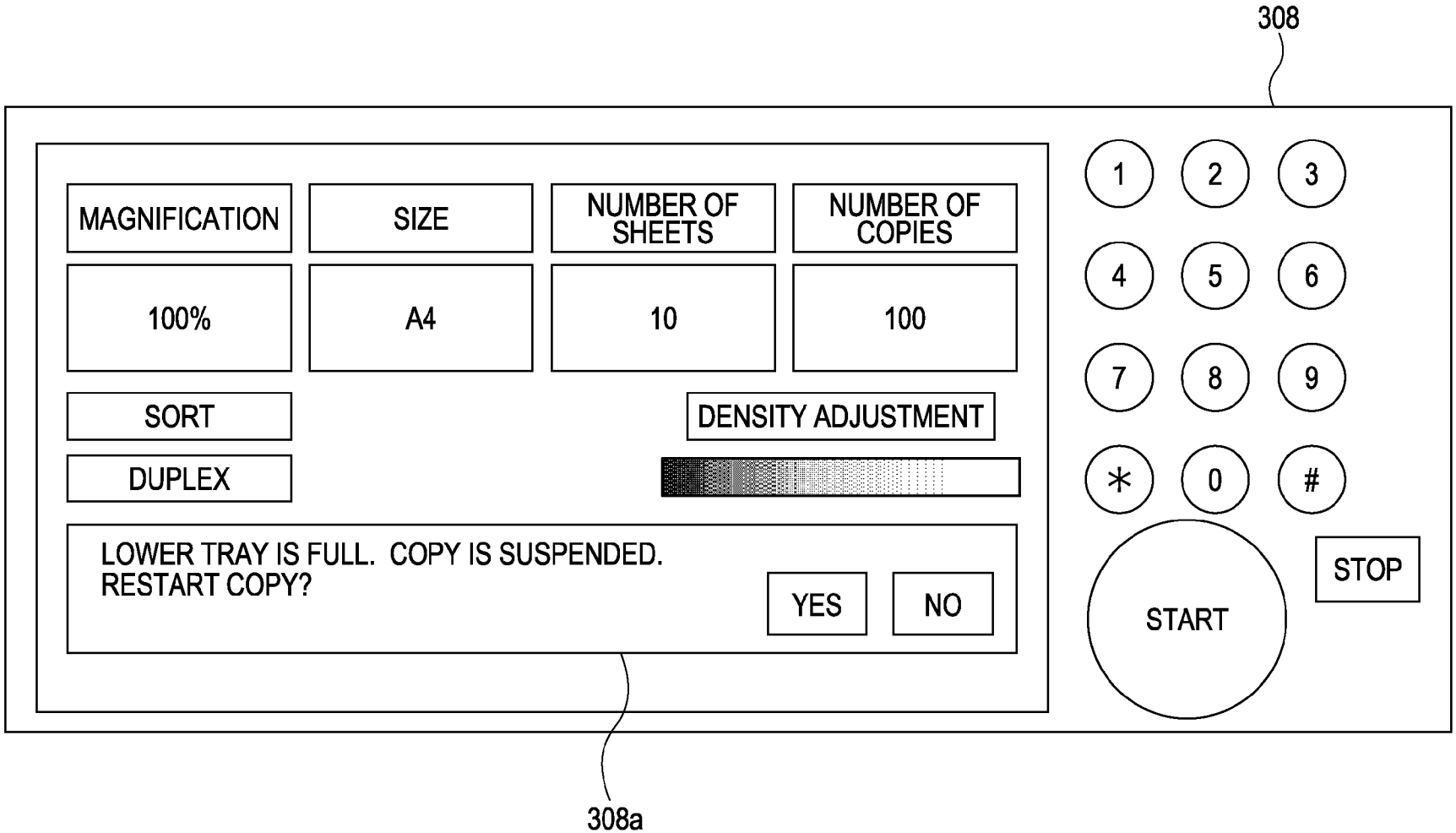
FIG. 14 is a diagram showing information displayed on the operation portion.
Figure 15:
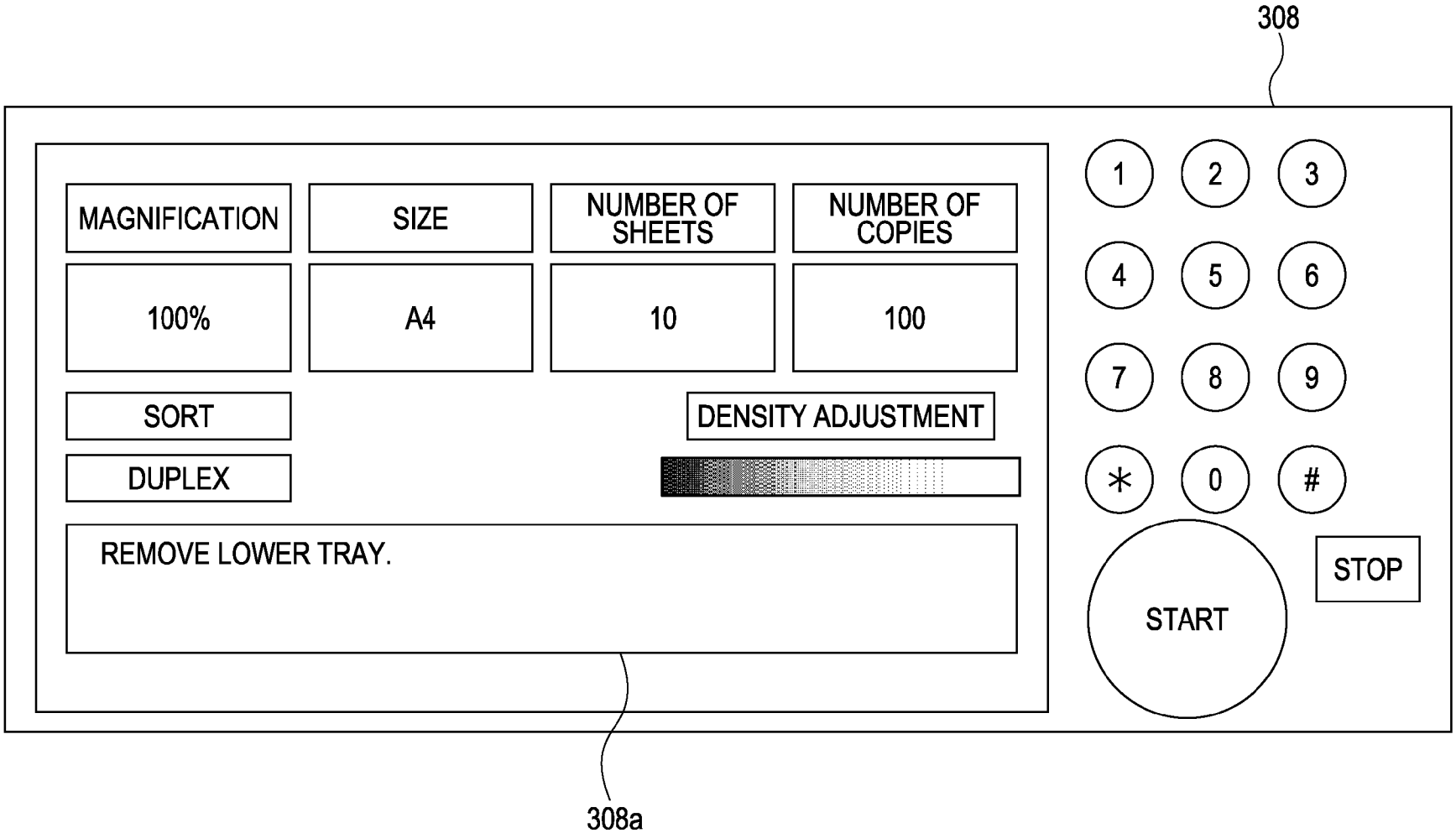
FIG. 15 is a diagram showing another information displayed on the operation portion.

Then, in step S3003, the CPU circuit portion 305 of the control device 950 causes information that the first tray 201 is full to be displayed on the display 308*a* of the operation portion 308, as shown in FIG. 14. Such information noticing the full state may be alternatively given to the user by generating a warning sound or light.

In step S3004, the CPU circuit portion 305 urges the user through the operation portion 308 to select whether or not to continue the sheet stacking operation. If the operation is to be continued, in subsequent step S3005, a message urging to remove the sheets on the first tray 201 that has been detected to be full is displayed, as shown in FIG. 15.

In subsequent step S3006, the CPU circuit portion 450 checks whether or not the second tray 200 has been removed, by monitoring the signal of the second-tray-removal detection sensor 1508. If it is detected that the second tray 200 has been removed, then in subsequent step S3007, the CPU circuit portion 450 drives the first-tray motor M13 so as to lower the first tray 201 to the predetermined position. Further, in step S3008, the CPU circuit portion 450 drives the second-tray motor M14 so as to raise the second-tray arms 1700 to the predetermined position.

In step S3009, the CPU circuit portion 450 determines, in accordance with the results of detections performed by the second-tray-arm-position detection sensor 1801 and the first-tray-arm-position detection sensor 1802, that the positions of the second-tray arms 1700 and the first tray 201 has been switched. In subsequent step S3010, the CPU circuit portion 450 transmits to the CPU circuit portion 305 of the control device 950 information that the image forming operation can be restarted, and cancels the suspension of the image forming operation in the printer 300 and the suspension of the sheet stacking operation in the finisher 1, whereby the sheet stacking operation is restarted.

Description of Control Operation when Tray Position Switching is not Performed

Figure 16:
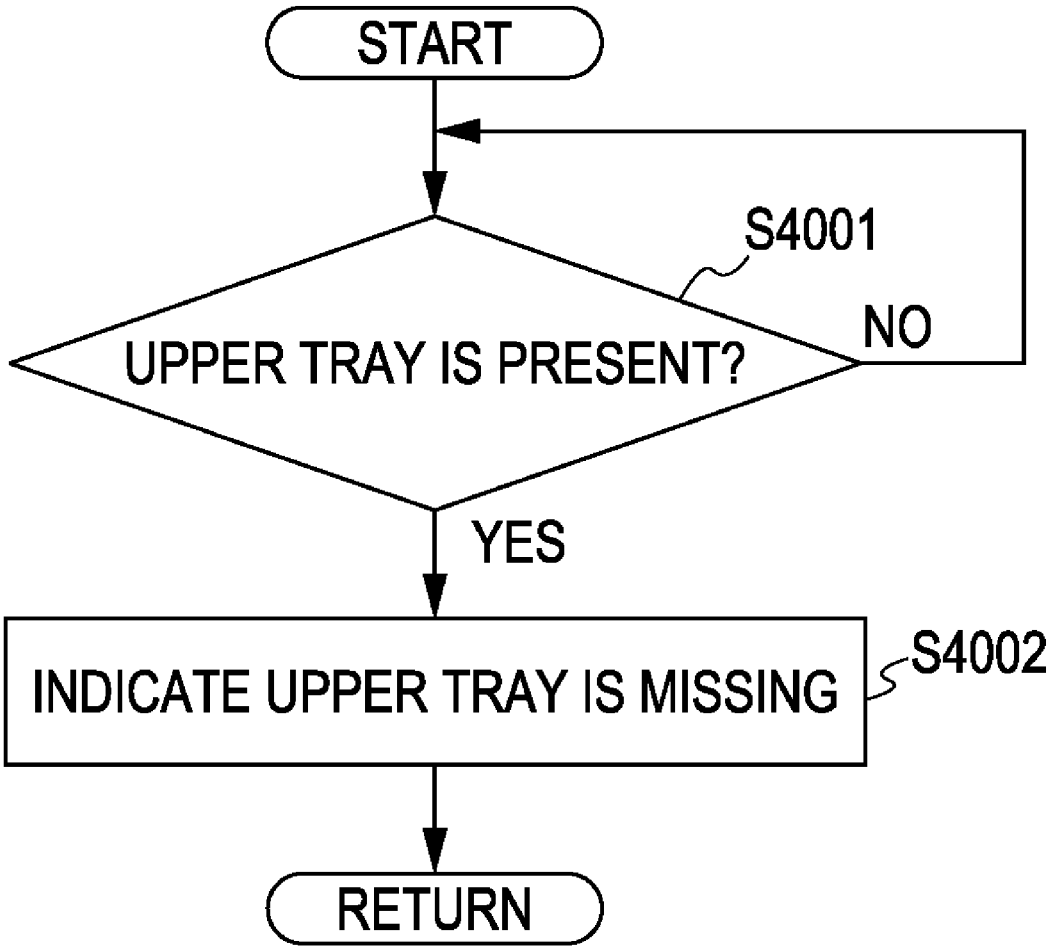
FIG. 16 is a flowchart showing a control operation when tray position switching according to the embodiment of the present invention is not performed.

The CPU circuit portion 450 determines that tray position switching is executable if the CPU circuit portion 450 recognizes that either the first- or second-tray arms 1701 or 1700 do not have the corresponding tray thereon. However, if an instruction to perform tray position switching is issued in a state where the tray arms residing at the upper stackable position do not have the corresponding tray thereon, there is a possibility of the tray at the lower position that is full being raised again. If the tray that is full is raised to the stackable position, no more sheets can be stacked thereonto. Such an operation is unnecessary. Therefore, if the tray arms at the upper stackable position, do not have the corresponding tray thereon, the CPU circuit portion 450 determines that the instruction to perform tray position switching has been mistakenly issued, and do not initiate tray position switching. The control operation in which tray position switching is not performed will be described with reference to FIGS. 16 and 17.

Figure 17:
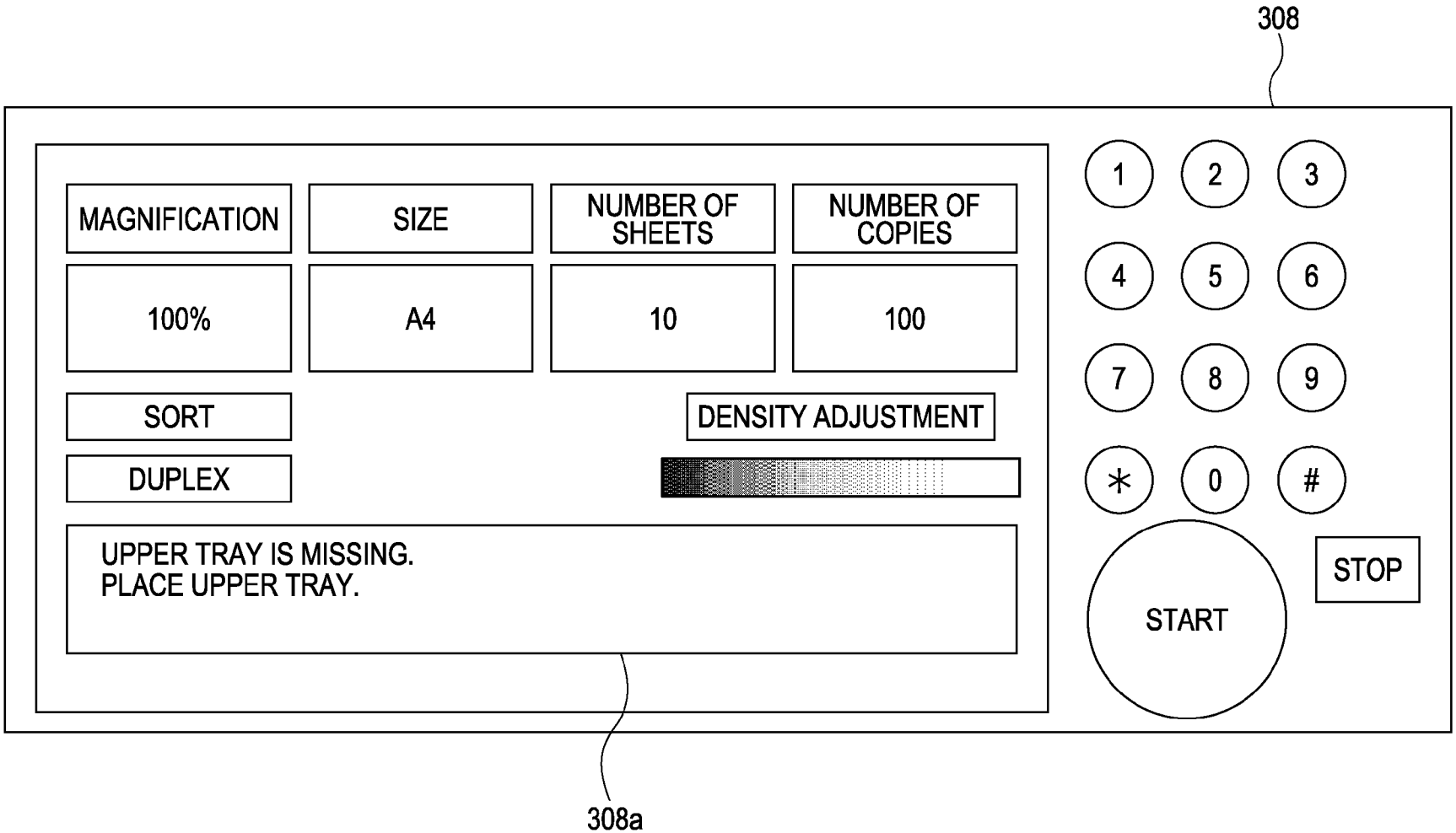
FIG. 17 is a diagram showing another information displayed on the operation portion.

The following description is based on the premise that the first tray 201 resides at the upper position. In step S4001, the CPU circuit portion 450 checks the presence of the first tray 201 by monitoring the signal of the first-tray-removal detection sensor 1509. If the first tray 201 is not present, in subsequent step S4002, information noticing such a situation is displayed on the display 308*a* of the operation portion 308, as shown in FIG. 17. In this case, tray position switching is not performed. The information displayed on the display 308*a* of the operation portion 308 may additionally include information or any indication urging to place the first tray 201. When the tray arms at the upper position do not have the corresponding tray, the operation of tray position switching ends, and it is determined that both tray arms reside at the respective stackable positions. Thus, performance of unnecessary tray position switching is prevented. Then, the tray that has been missing is placed on the corresponding set of tray arms so that sheets can be stacked. In this manner, productivity can be improved.

Description of Control Operation when all Trays are Missing

Figure 18:
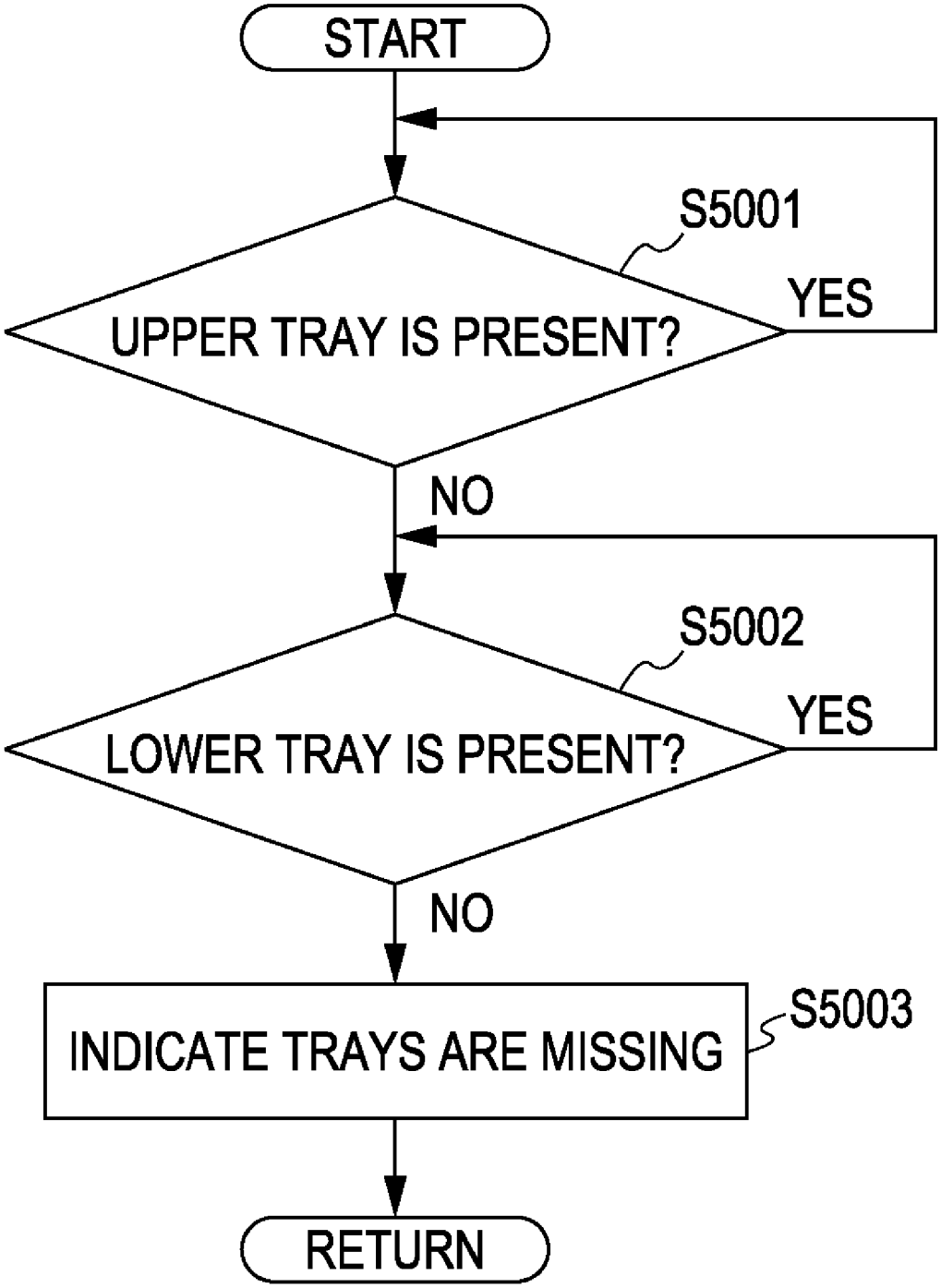
FIG. 18 is a flowchart showing a control operation when all of the trays according to the embodiment of the present invention are missing.

The control operation performed when all trays are missing will be described with reference to FIGS. 18 and 19. Minimization of the period in which sheets cannot be stacked because of the absence of the trays on the respective tray arms leads to high productivity. The operation described below is to minimize such a period.

In step S5001, the CPU circuit portion 450 of the finisher control portion 501 monitors the signal of the first-tray-removal detection sensor 1509 and checks the presence of the first tray 201. Then, in step S5002, the CPU circuit portion 450 monitors the signal of the second-tray-removal detection sensor 1508 and checks the presence of the second tray 200.

Figure 19:
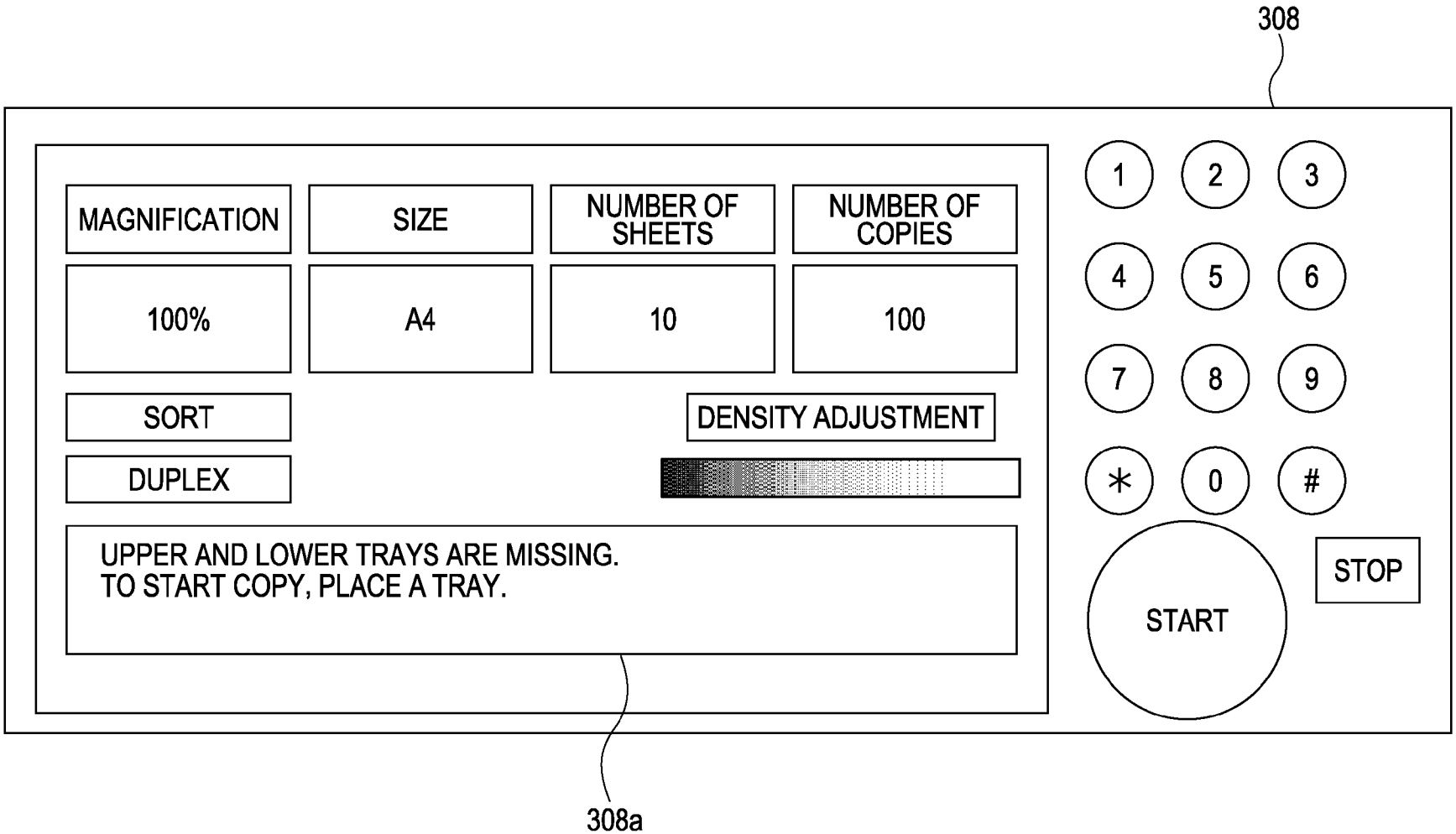
FIG. 19 is a diagram showing another information displayed on the operation portion.

If both trays are missing, in subsequent step S5003, information indicating such a situation is displayed on the display 308*a* as shown in FIG. 19, without allowing the sheet stacking operation to be performed. After the information urging the user to place a tray on either tray arms is displayed, the tray arms on which the corresponding tray has been placed is controlled to be moved to the upper position.

The embodiments described above concern the configuration including two sheet stacking trays. Alternatively, the present invention can be applied to a configuration including three or more trays as long as a tray that is in a removable state and a tray that is ready for sheet stacking are provided simultaneously.

If the positional relationship between the notches allowing tray position switching and the arm-receiving recesses provided in each tray and the maximum number of stackable sheets, in combination, result in the strength of the tray being insufficient, three or more tray arms, as the sub-members of the supporting member, may be provided on the premise that all of the tray arms are disposed outside the range of the discharge port.

The embodiments described above concern the case where the sheet stacking apparatus is the finisher 1 connected to the body 10 of the image forming apparatus. Alternatively, the sheet stacking apparatus according to the present invention may be incorporated into the printer 300.

The embodiments described above concern the configuration in which the operation of tray position switching is controlled by the finisher control portion 501 included in the finisher 1. Alternatively, the CPU circuit portion 450 may be integrated into the control device 950 of the printer 300 so that the operation is directly controlled from the body 10 of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-057308 filed Mar. 7, 2008 and No. 2009-034035 filed Feb. 17, 2009, which are hereby incorporated by reference herein in their entirety.

What is claimed is:

1. A sheet stacking apparatus comprising:

first and second stacking trays onto which sheets conveyed thereto are stacked;

a first supporting member configured to support the first stacking tray movably;

a second supporting member configured to support the second stacking tray movably along a moving area in which the first tray is movable; and a moving portion configured to move the first and second supporting members individually, wherein the first and second supporting members removably support the first and second stacking trays, respectively, wherein the first stacking tray has a form through which the second supporting member is capable of passing, and wherein when the first stacking tray having sheets stacked thereon is moved, the first stacking tray and the second supporting member not supporting the second stacking tray thereon are capable of switching relative positions of each other in a moving direction of the first stacking tray.

2. The sheet stacking apparatus according to claim 1, wherein the first and second supporting members are arranged at staggered positions so as to be capable of passing each other.

3. The sheet stacking apparatus according to claim 2, wherein the first stacking tray has a notch allowing the second supporting member to pass through, the second stacking tray has a notch allowing the first supporting member to pass through, and the notch of the first stacking tray and the notch of the second stacking tray are provided at staggered positions.

4. The sheet stacking apparatus according to claim 1, wherein the first and second supporting members each include a plurality of sub-members arranged at staggered positions so as to be capable of passing each other, the sub-members of the first supporting member and the sub-members of the second supporting member being arranged at different intervals.

5. The sheet stacking apparatus according to claim 4, wherein the first stacking tray has a plurality of notches allowing the sub-members of the second supporting member to pass through, the second stacking tray has a plurality of notches allowing the sub-members of the first supporting member to pass through, and the notches of the first stacking tray and the notches of the second stacking tray are provided at different intervals.

6. The sheet stacking apparatus according to claim 1, wherein the first stacking tray has a notch allowing the second supporting member to pass through.

7. The sheet stacking apparatus according to claim 6, wherein the notches are provided at an interval in a direction orthogonal to the movement direction, the interval being larger than a maximum width of the sheets that are to be stacked onto the first and second stacking trays.

8. The sheet stacking apparatus according to claim 1, further comprising:

a tray detector configured to detect the presence and absence of the first and second stacking trays on the first and second supporting members individually; and a control portion configured to control the moving portion, wherein the control portion determines that the position switching is performable if it is detected that either of the first and second supporting members is lacking the corresponding stacking tray.

9. The sheet stacking apparatus according to claim 8, further comprising:

a height detector configured to detect heights of sheet stacks on the first and second stacking trays individually, wherein the control portion suspends a sheet stacking operation if it is detected that the height of the sheet stack on either of the first and second stacking trays has reached a predetermined height, the control portion performing the position switching after suspending the sheet stacking operation if it is detected that either of the first and second supporting members is lacking the corresponding stacking tray.

10. The sheet stacking apparatus according to claim 9, further comprising:

a position detector configured to detect positions of the first and second supporting members individually, wherein when the position switching is performed, the control portion restarts the sheet stacking operation if the control portion determines that the positions of the first and second supporting members have been switched.

11. The sheet stacking apparatus according to claim 8, wherein the control portion withholds performance of the position switching if the control portion has determined that one of the first and second supporting members that resides at a stackable position is lacking the corresponding stacking tray when an instruction to perform the position switching is issued.

12. The sheet stacking apparatus according to claim 8, wherein, if the control portion has determined that both of the first and second supporting members are lacking the respective stacking trays when an instruction to perform the position switching is issued, the control portion indicates information urging to place either of the stacking trays.

13. A sheet processing apparatus comprising:

a sheet processing portion configured to process a sheet; and the sheet stacking apparatus according to claim 1 onto which the sheet that has been processed is stacked.

14. An image forming apparatus comprising:

an image forming portion configured to form an image on a sheet; and the sheet stacking apparatus according to claim 1 onto which the sheet having the image formed thereon is stacked.

* * * * *